US010820109B2

(12) United States Patent
Jacques

(10) Patent No.: US 10,820,109 B2
(45) Date of Patent: Oct. 27, 2020

(54) DIAPHRAGM ARRANGEMENT FOR A PLANAR DYNAMIC SOUND TRANSDUCER, AND METHODS TO PRODUCE THEREFOR

(71) Applicant: Sennheiser electronic GmbH & Co. KG, Wedemark (DE)

(72) Inventor: Roland Jacques, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/483,802

(22) PCT Filed: Jan. 17, 2018

(86) PCT No.: PCT/EP2018/051059
§ 371 (c)(1),
(2) Date: Aug. 6, 2019

(87) PCT Pub. No.: WO2018/141544
PCT Pub. Date: Aug. 9, 2018

(65) Prior Publication Data

US 2020/0053473 A1 Feb. 13, 2020

(30) Foreign Application Priority Data

Feb. 6, 2017 (DE) ..... 10 2017 102 219

(51) Int. Cl.
*H04R 9/04* (2006.01)
*H04R 7/04* (2006.01)
(Continued)

(52) U.S. Cl.
CPC ..... *H04R 9/047* (2013.01); *H04R 7/04* (2013.01); *H04R 7/18* (2013.01); *H04R 9/025* (2013.01);
(Continued)

(58) Field of Classification Search
CPC ..... H04R 13/00; H04R 9/047; H04R 9/048
See application file for complete search history.

(56) References Cited

U.S. PATENT DOCUMENTS 4,281,233 A 7/1981 Coupek et al.
5,095,357 A 3/1992 Andoh et al.
(Continued)

FOREIGN PATENT DOCUMENTS

DE 11 84 803 1/1965
DE 12 34 266 1/1967

OTHER PUBLICATIONS

Search Report for Application No. PCT/EP2018/051059 dated Mar. 20, 2018.

*Primary Examiner* — Walter F Briney, III
(74) *Attorney, Agent, or Firm* — Haug Partners LLP

(57) ABSTRACT

A planar dynamic sound transducer includes a magnet arrangement which for example comprises bar magnets and a fixing frame, and a diaphragm arrangement. The diaphragm arrangement has a tensioned diaphragm film (diaphragm for short), a tensioning device for the diaphragm, and a conductor structure applied to the diaphragm. When the conductor structure is conventionally provided with electrical connections mechanically sensitive connections and/or high transfer resistances often occur. An improved diaphragm arrangement for a planar dynamic sound transducer includes a support frame having at least one contacting surface, and a diaphragm tensioned on the support frame, and which at least one electrically conductive conductor track is applied by coating. At least one end of the conductor track applied by coating extends on to the contacting surface of the support frame. The connecting line can be connected to the contacting surface of the support frame by way of a solder join.

11 Claims, 4 Drawing Sheets

(51) Int. Cl.

| | |
|---|---|
| ***H04R 7/18*** | (2006.01) |
| ***H04R 9/02*** | (2006.01) |
| ***H04R 9/06*** | (2006.01) |
| *H04R 1/06* | (2006.01) |

(52) U.S. Cl.
CPC ..... *H04R 9/06* (2013.01); *H04R 1/06* (2013.01); *H04R 2400/11* (2013.01)

(56) References Cited

U.S. PATENT DOCUMENTS

| | | | | |
|---|---|---|---|---|
| 6,097,830 | A | 8/2000 | Zelinka et al. | |
| 6,137,891 | A | 10/2000 | Porrazzo et al. | |
| 6,201,286 | B1 | 3/2001 | Nagasaka | |
| 2003/0174856 | A1* | 9/2003 | Johannsen ..... | H04M 1/03 381/401 |
| 2004/0008858 | A1* | 1/2004 | Steere ..... | H04R 9/047 381/398 |
| 2004/0009716 | A1 | 1/2004 | Steere et al. | |
| 2006/0193107 | A1* | 8/2006 | Kami ..... | H04R 1/06 361/600 |
| 2015/0021758 | A1 | 1/2015 | Tsai et al. | |

* cited by examiner

DIAPHRAGM ARRANGEMENT FOR A PLANAR DYNAMIC SOUND TRANSDUCER, AND METHODS TO PRODUCE THEREFOR

The present application claims priority from International Patent Application No. PCT/EP2018/051059 filed on Jan. 17, 2018, which claims priority from German Patent Application No. DE 10 2017 102 219.8 filed on Feb. 6, 2017, the disclosures of which are incorporated herein by reference in their entirety.

FIELD OF THE INVENTION

It is noted that citation or identification of any document in this application is not an admission that such document is available as prior art to the present invention.

The invention concerns a planar dynamic transducer, in particular a planar dynamic sound transducer.

Planar dynamic sound transducers usually comprise a magnet arrangement having a plurality of magnet bars arranged in parallel and a diaphragm, wherein the plane of the magnet arrangement is parallel to the plane of the diaphragm. In operation for sound reproduction an electric current flows through a flat coil mounted directly on the diaphragm, wherein a deflection force is produced by virtue of the magnetic field of the magnet arrangement. That force deflects the diaphragm and generates sound in that way. In operation for sound recording, that is to say as a microphone, a corresponding electric current is induced in the coil by the sound excitation of the diaphragm. The basic known structure of a planar dynamic sound transducer is shown in FIG. 1. It includes bar magnet 100*a* and 100*b* each having an orientation of the magnetic poles, that alternates through 180°, a supporting diaphragm film 110, a conductor structure 122 applied thereto, conducting surfaces 125 and 125*a* at the ends of the conductor structure, and a support frame 130 on which the diaphragm film 110 is fixed for example by adhesive. The illustrated arrangement of the bar magnets generates a magnetic field extending horizontally in the plane of the diaphragm film. When current flows through the conductor structure the magnetic field generated thereby interacts with that of the bar magnets and a drive force acting perpendicularly to the diaphragm plane is produced. As a result the diaphragm film which is tensioned in self-supporting relationship in that region is deflected and a variation in the pressure of the surrounding air, that is to say sound, is produced. By inverting that principle sound waves can be converted into electric alternating current.

Different methods are used in the state of the art to produce the conductor structures on the support film. On the one hand there is the possible option of connecting suitable material (thin wires, thin film and so forth) to the carrier film by adhesive, lamination, ultrasonic welding and so forth, and, prior to or after that connecting step, producing the track structure by cutting, stamping, laser cutting, laser removal, photolithography or the like.

On the other hand alternatively it is possible to build up on the carrier material by a coating method a conductive layer which has the desired track structure from the outset for example by virtue of local focusing of the coating (for example by aerosol or inkjet printing of metal particles) or by a shadowing mask, or the track structure is produced by selective removal by laser or photolithography.

Electrical contacting of those coated track structures is not a trivial matter as the metallic layers produced are too thin and fragile to achieve a secure and very low-resistance connection directly for example by soldering or bonding. In contrast to electrostatic or capacitive sound transducers, in the case of planar dynamic systems the overall resistance is generally relatively low, for example in the region of between 16 and 50 Ohms, which has the result that transfer resistances can have measurable negative effects. In the state of the art contacting is generally effected by mechanically pressing a conductive part on to the coated conductor track to achieve a solid basis for example for a solder connection.

FIG. 2*a* shows by way of example, as a cross-section in the region of the contacting surface 125 or 125*a*, the carrier film or diaphragm 110, the metal coating 120, the support frame 130, the pressed conductive part 140, the screw connection 150, 151 producing the contact pressing pressure, and the connection of a connecting line 170 by way of a solder connection 160. With this structure however the conductor track can already be damaged or pierced by very small irregularities and unevenness.

A popular conductor material is aluminum which upon contact with oxygen directly produces an oxide layer which in principle is insulating. The described contacting by pressing the part on the conductor track can be adversely affected thereby. In addition there is the risk that in the course of time the contact pressing pressure drops off due to vibration, shaking, material shrinkage and fatigue and so forth, or moisture in the air or other substances pass due to capillary forces between the contact surfaces and cause them to be corroded or fouled. In any of those cases contact resistances occur, which worsen the efficiency of the sound transducer as far as complete failure due to an interruption.

An alternative contacting option provides that an electrically conductive material which is initially or permanently viscous, for example silver conductive adhesive, is used for making the connection between the conductor track and other contacting structures, for example a printed circuit board. FIG. 2*b* shows by way of example an additional circuit board 180 with a copper lining 181 and a solder connection 160 applied thereto. The connection in relation to the metal coating 120 is produced by means of a through-contacting (referred to as a "via") 182 filled with a conductive adhesive 190. Such conductive viscous material however generally involve a lower level of conductivity than metals, whereby the degree of efficiency is reduced. In addition the sometimes complex chemical composition of those substances can be problematic in relation to long-term stability of the electric connection.

An additional requirement arises in regard to configurations involving multiple conductor track structures. In that situation not just one but a plurality of conductor tracks are provided per bar magnet. In electrical terms those conductor tracks are serially connected so that the driving current flows through the same magnetic field a plurality of times, which corresponds to a plurality of windings in a regular cylindrical coil. The factor "l" for the length in the formula F=B*l*i is multiplied and thus also the drive force "F". That however is at the expense of a high system resistance and a multiple mass of the conductor structure. FIG. 3 shows a planar coil with multiple conductor tracks 122 and the necessary external return lines 123, 124. Those return lines require additional space on the diaphragm, increase the system resistance, and make contacting of the conductor track ends 125, 125*a* more difficult.

On the German patent application from which priority is claimed the German Patent and Trade Mark Office searched the following documents: DE 11 84 803 B, DE 12 34 266 B, U.S. Pat. No. 6,201,286 B1, US 2015/0 021 758 A1, U.S. Pat. Nos. 6,097,830 A, 4,281,233 A, 3,674,946 A and 5,095,357 A.

SUMMARY OF THE INVENTION

The present invention improves the second of the above-specified manufacturing methods, that is to say a coating method for diaphragm arrangements, as well as a diaphragm arrangement produced by coating.

An object of the present invention is to provide an improved diaphragm arrangement for planar dynamic sound transducers, in which the conductor tracks are easier to connect and that connection is more robust and/or has improved conductivity.

According to the invention that object is attained by direct contacting, wherein at least one electrically conductive layer is applied as a conductor track by coating to the diaphragm and wherein at least one end of the conductor track extends beyond the diaphragm on to a contacting surface outside the diaphragm.

According to the invention a diaphragm arrangement for planar dynamic sound transducers comprises a support frame having at least one contacting surface and a diaphragm which is tensioned on the support frame and to which at least one electrically conductive conductor track is applied by coating, wherein at least a part of the conductor track applied by coating extends on to the at least one contacting surface of the support frame. That part is preferably arranged at or near the end of the conductor track.

Also provided is a planar dynamic sound transducer as can be used for example in a headphone or microphone, with a diaphragm arrangement according to the invention.

Further provided is a method of producing a diaphragm arrangement for a planar dynamic sound transducer comprising the steps of fixing a diaphragm on a support frame provided with at least one contacting surface and coating the diaphragm fixed on the support frame with an electrically conductive material in such a way that at least one conductor track is produced, wherein the coating also extends on to the at least one contacting surface of the support frame. In that case the conductor track is electrically conductingly connected to the contacting surface.

BRIEF DESCRIPTION OF THE DRAWINGS

Further details and advantageous embodiments are illustrated in the drawings in which.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
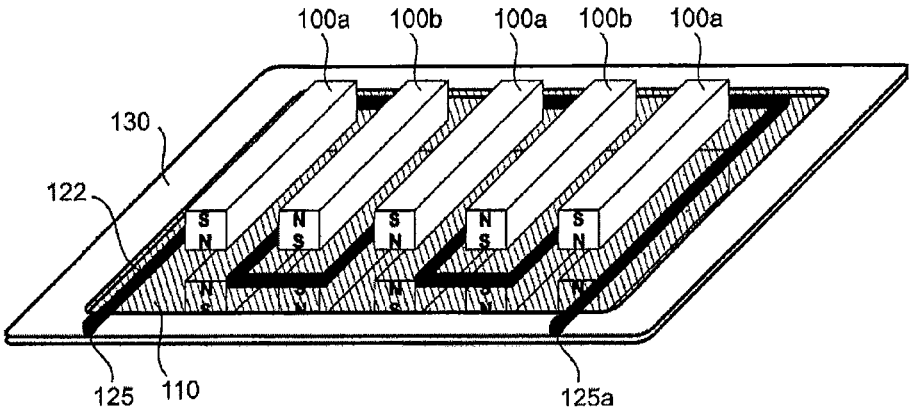
FIG. 1 shows the basic structure of planar dynamic sound transducers.
Figure 2:
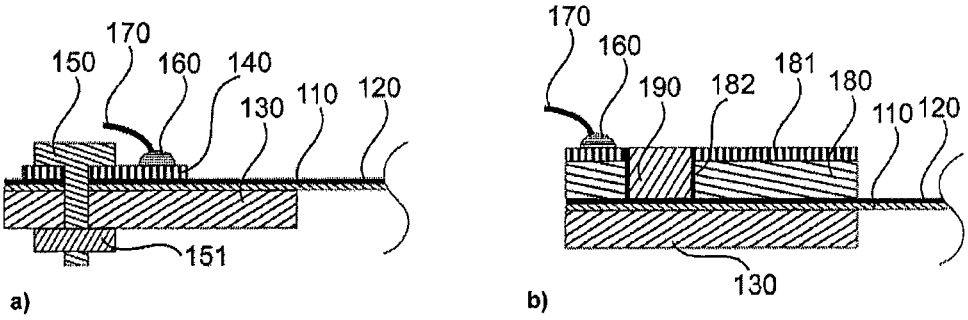
FIG. 2 shows the known contacting of a diaphragm arrangement by pressing on a contacting surface or adhesive with viscous conductive material.
Figure 3:
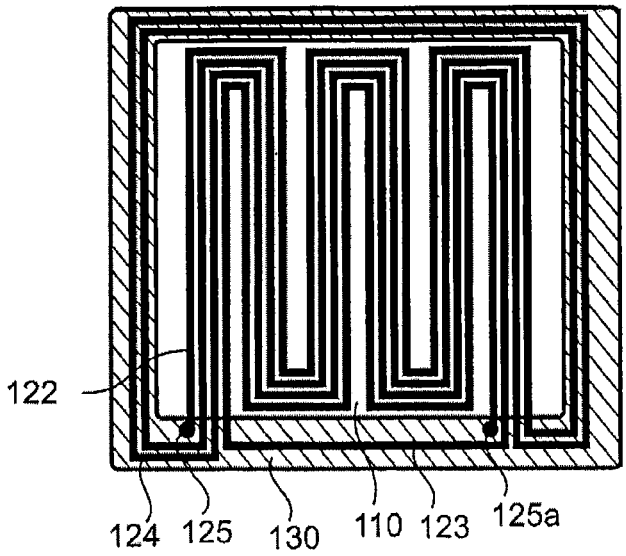
FIG. 3 shows a known arrangement of multiple conductor tracks on a diaphragm.
Figure 4:
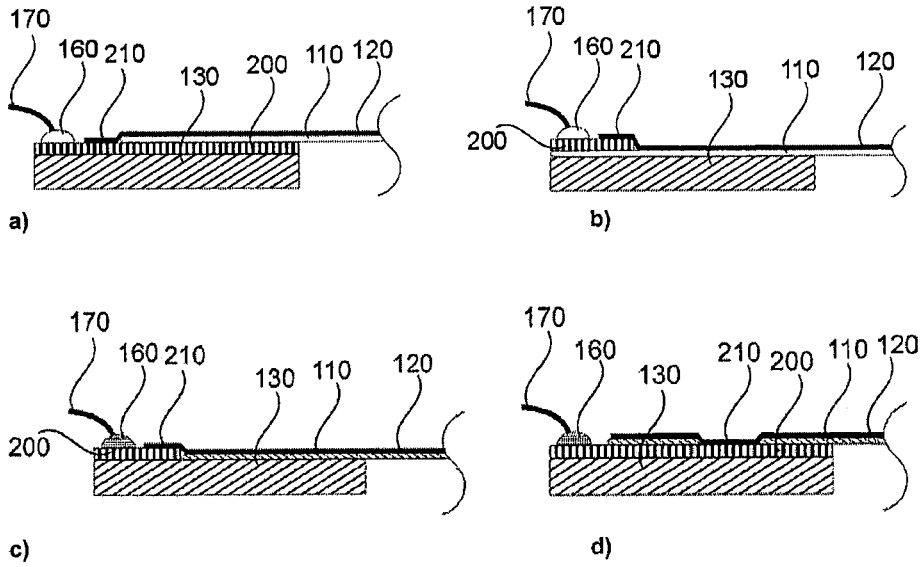
FIG. 4 shows the basic principle of direct contacting of conductor tracks applied by coating in various variants.

FIG. 4 shows the basic principle of direct contacting of conductor tracks applied by coating, in various variants. In this case the diaphragm film of the sound transducer is coated during the layer production step by coating with an electrically conductive material as far as its edge and beyond, more specifically on to an adjoining electrically conductive surface. As viewed on the overall system plane, that surface must be subdivided into at least two electrically separated regions in order to prevent a short-circuit between the at least two connecting points.

The coating operation can be implemented for example by physical or chemical gas deposition methods, vapor deposit, sputtering, plasma coating, laser transmission, aerosol jet printing, inkjet printing and so forth. Suitable conductive materials are known, for example gold, copper or aluminum.

In the arrangement shown in FIG. 4*a* the support frame 130 has a conductive surface 200, for example a copper lining. In this example, both, the support frame 130 and the conductive surface 200, extend beyond the edge of the diaphragm film 110. During the coating operation in which the conductor track 120 is produced on the diaphragm 110 the diaphragm is already fixed on the support frame 130. At the same time and by the same formation process a connection is also produced between the conductor track 120 and the conductive surface of the contacting surface 200 by the conductive coating of the diaphragm in a region 210 referred to as the "direct contact zone" coming into direct contact with the conductive layer or contacting surface 200. The connecting line 170 can be connected thereto by way of a solder join 160. In that way the solder join 160 of the connecting wire 170 can be spatially separated from the direct contact zone 210 of the applied conductor track 120. That is advantageous because in that way damage to the sensitive applied conductor track 120 when soldering the connecting line 170 in place is avoided. In addition the solder join 160 is thereby independent of the contacting of the coated diaphragm so that it is possible for the solder join 160 to be already applied prior to the coating process on the contacting surface 200.

As shown in FIG. 4*b* alternatively the conductive layer of the contacting surface 200 can also be disposed above the diaphragm film 110. Then the contacting surface is a component which is applied to the diaphragm but in that case is fixedly connected to the support frame, or a part of such a component, while in most other described situations the contacting surface can be part of the support frame. In some examples the diaphragm is applied to the conductive layer of the contacting surface 200. As shown in FIG. 4*c* however the contacting surface 200 can also be beside the diaphragm film 110. In that situation a small gap which may possibly occur therebetween can also be filled with the conductive coating material. In all those situations the conductive coating 120 extends beyond the edge of the diaphragm on to the contacting surface.

In FIG. 4*d* the direct contact zone 210 is in a break in the diaphragm film 110. That break can be for example an opening produced by cutting, stamping, milling and the like in the diaphragm film. Other arrangements of those or similar elements are also possible with simultaneous utilization of the described basic concept of direct contacting.

Figure 5:
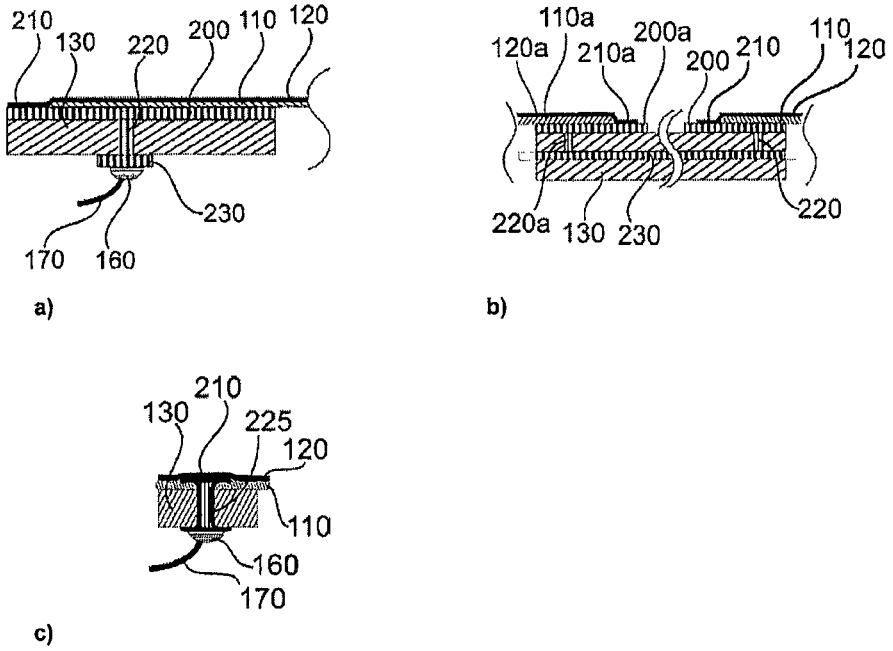
FIG. 5 shows variants of direct contacting with through-contacting of the support frame.

Further variants of direct contacting with through-contacting ("via") of the support frame are shown in FIG. 5. In the FIG. 5*a* arrangement the connection to the direct contact zone 210 of the coating 120 is implemented similarly to FIG. 4*a,* but in addition there is a through-contacting 220 and a contact surface 130 which is applied on the underside of the support frame 130 and to which the solder join 160 can then be applied.

In the FIG. 5*b* arrangement the contacting surface is the surface of a multi-layer circuit board. That can be part of the support frame 130 or fixedly connected thereto. In the example shown the through-contacting 220 leads to a second layer or intermediate layer 230 of the multi-layer board which leads to any other point in the support frame. There, there is a further through-contacting 220*a,* by way of which a further conductor structure 120*a* is then contacted on the diaphragm. In that way for example a plurality of conductor tracks on the diaphragm can be connected to constitute a plurality of windings of a single coil. Besides the robust and low-resistance connection option a further advantage of this arrangement is that the conventionally necessary return connections on the diaphragm can be reduced in length or entirely eliminated. As those returns generally extend transversely relative to the magnetic field, no force is generated in them; they are only necessary for connecting or joining further windings of the coil. Accordingly the reduction therein or elimination thereof increases the area which can be effectively used on the diaphragm and also reduces the diaphragm mass. For example it is possible to cover the diaphragm with only straight-line conductor tracks which are connected together by way of contacting surfaces on the support frame. That is shown in FIG. 7*b* and described hereinafter.

While in the above-described examples the contacting surface 200 was arranged between the diaphragm film 110 and the support frame 130 other arrangements are also possible. In a variant shown in FIG. 5*c* the through-contacting is produced by firstly the diaphragm film 110 being fixed on the support frame 130 and then a suitable rivet 225 being introduced into a bore provided for same. In that case the diaphragm film is locally recessed or pierced and fixed by the collar of the rivet. On the underside of the support frame the rivet connection is carried out by deformation of the rivet with a suitable tool. By virtue of suitable configurations in respect of the rivet and the tool a mechanically highly stable electrical connection is made between the two sides of the support frame. In the following application of the coating 120 the top side of the rivet is also coated as the coating surface of the diaphragm arrangement and thus a stable electrical connection 210 is made between the rivet and the rest of the coating surface 120. Then for example a direct solder join 160 to the connecting wire 170 can be made on the underside of the support frame, or it is possible to provide there a conductive layer to which the rivet is connected by deformation thereof by pressing. That then leads for example to other, spatially separated through-contacting rivets or to a spatially separated solder join. Basically rivets represent a simple, stable and in that respect electrically conductive option for fixing the diaphragm on the support frame. The rivets can be but do not have to be used as the through-contacting means.

Figure 6:
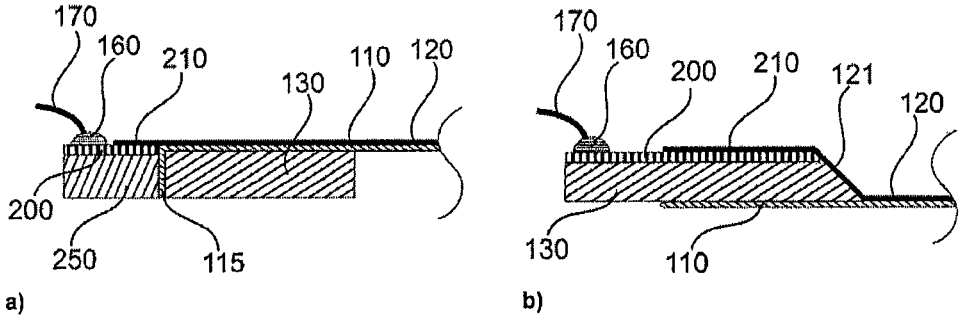
FIG. 6 shows direct contacting of conductor tracks applied by coating with various variants of the support frame.

FIG. 6 also shows various variants of the support frame with direct contacting of conductor tracks applied by coating. In FIG. 6*a* by way of example an additional outer support frame 250 is added, and the diaphragm film 110 is passed over the outer edge of the (inner) support frame 130 so that it covers same. The diaphragm film can be fixed for example by adhesive or clamping 115 between those two parts. By controlledly passing the diaphragm film 110 over the edge and by virtue of the selected thickness relationships of the inner support frame 130, the outer support frame 250 and the contact surface 200, it is possible to provide that the coating 120 is flat even in the transitional region. That improves the connection of the coating 120 in relation to the direct contact zone 210. The structure shown in FIG. 6*b* basically corresponds to that shown in FIG. 4*a,* but the diaphragm film 110 is disposed at the underside of the support frame 130. The coating 120 is produced on the top side of the film and extends over a bevel or chamfer 121 of the support frame directly towards the direct contacting means 210 on the conductive surface 200. The bevel 121 simplifies the coating operation. In this variant application and delimitation of the diaphragm film 110 is simpler as the coating 120 does not extend over the outer edge of the film.

Figure 7:
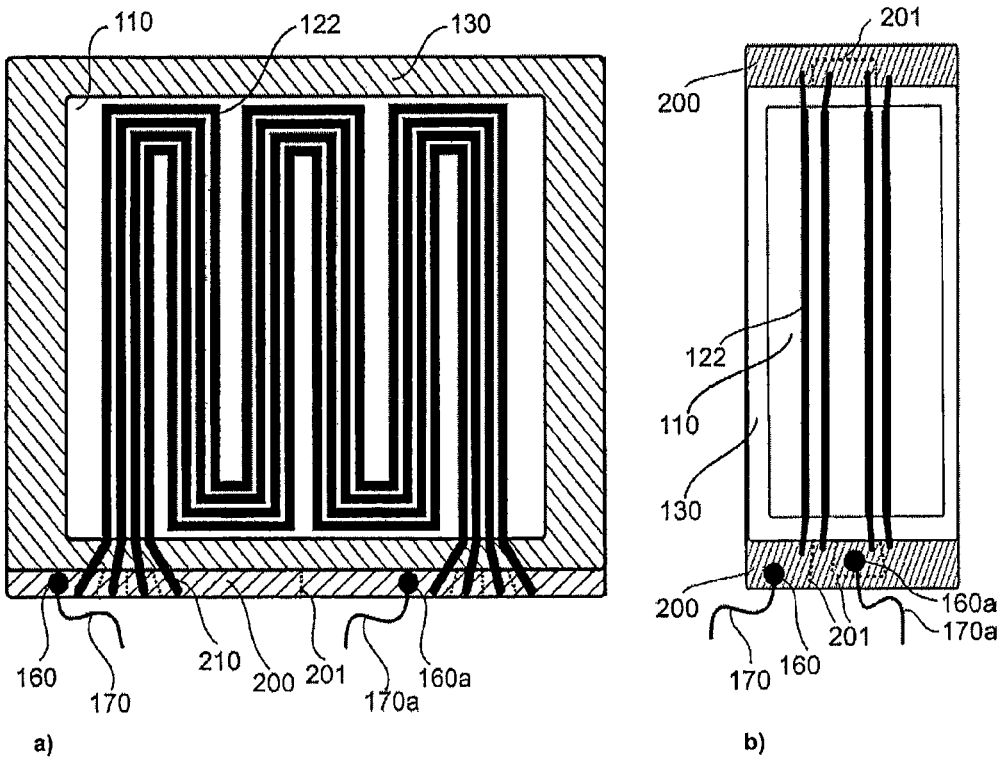
FIG. 7 shows direct contacting according to the invention in the case of a plurality of conductor structures with and without return means.

FIG. 7 shows direct contacting according to the invention with multiple conductor structures. In FIG. 7*a* four mutually separated conductor structures 122 are applied in a meandering configuration to the diaphragm 110. Each conductor structure is connected at both ends by direct contacting to a region of the contacting surface, wherein the various regions of the contacting surface are electrically separated from each other by interruptions 201. The contacting surfaces 200 can be the surfaces of a multi-layer circuit board which in turn can be part of the support frame 130. In a lower layer of the multi-layer board, which is not shown in FIG. 7*a,* the individual conductor structures 120 can be deliberately connected together, for example as in FIG. 5*b*.

In FIG. 7*b* four straight conductor structures 122 are applied to the diaphragm 110 and each conductor structure is connected at both ends by direct contacting to a region of the contacting surface. It will be noted however that in this case the interruptions 201 are arranged in such a way that two respective mutually juxtaposed conductor structures are connected together by way of common contacting surfaces 200. Therefore a multi-layer circuit board is not necessary so that the contacting surface 200 can be a single-layer configuration, for example a copper lining.

Embodiments can also be implemented, in which not all conductor tracks are connected serially as in FIGS. 7*a* and 7*b,* but are configured in two or more individually actuable parallel branches, or are even individually actuated.

Figure 8:
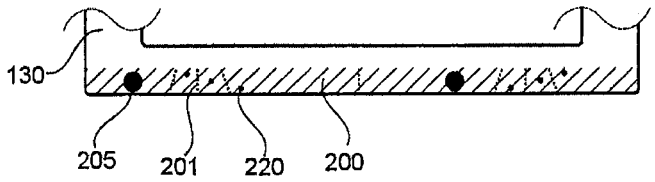
FIG. 8 shows the contacting surface as the uppermost layer of a multi-layer circuit board.
Figure 9:
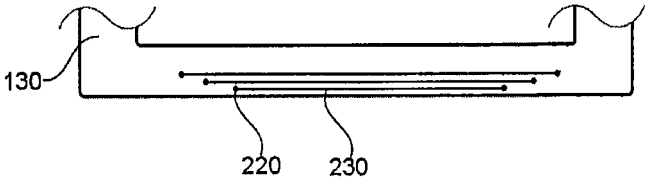
FIG. 9 shows a lower layer of the multi-layer circuit board.

FIG. 8 shows the layout of the contacting surface of the example shown in FIG. 7*a* as the uppermost layer of a multi-layer circuit board which can also serve directly as the support frame 130. The contacting surface 200, for example a copper lining, is subdivided into sub-regions by interruptions 201. Through-contacting means 220 connect the contacting surface 200 to a lower layer of the multi-layer circuit board, as shown in FIG. 9. That layer can be applied for example on the underside of the support frame. In this example each of the sub-regions contains a through-contacting 220 and is connected by direct contacting to an end of a conductor structure. The lower layer of the multi-layer circuit board connects two respective different through-contactings together, whereby return lines 230 are formed. They connect the conductor structures together to form a single coil. In that way the number and length of the return lines required on the diaphragm is reduced and the coating pattern is overall simplified. Provided on such regions of the contacting surface 200, that are connected to the ends of the coil, are connecting surfaces (pads) 205, to which the connecting lines 170, 170*a* can be soldered. The return connections 230 can be produced for example by photolithography from a copper surface. As such a copper conductor as the return is markedly thicker than the coating the return can be made almost resistance-free. The bonding of the connecting lines is also without problems and is highly stable. In addition there is no longer any need for space on the diaphragm for the conventional return lines. Embodiments are also possible in which the contacting surface 200 belongs to an electronic component which is applied to the support frame and which then belongs to the diaphragm arrangement.

The diaphragm arrangement according to the invention can advantageously be used for sound transducers, in particular for sound transducers in headphones, loudspeakers and microphones.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A diaphragm arrangement for a planar dynamic sound transducer comprising a support frame that has a first contacting surface; and a diaphragm that is tensioned on the support frame and to which at least one electrically conductive conductor track is applied by coating, wherein at least a part of the conductor track applied by coating extends beyond the diaphragm on to the first contacting surface of the support frame so that electrically conductive material is electrically conductingly connected to the first contacting surface.

2. The diaphragm arrangement as set forth in claim 1;

wherein two parts near the two ends of the at least one electrically conductive conductor track extend on to the first contacting surface and a separate second contacting surface of the diaphragm arrangement.

3. The diaphragm arrangement as set forth in claim 2;

wherein a plurality of conductor tracks, including the at least one conductor track and extending portion-wise in parallel, are applied by coating to the diaphragm, each conductor track having two ends; and wherein at least two conductor tracks of the plurality of conductor tracks are each electrically conductingly connected to the first and second contacting surfaces on the support frame by the coating respectively at or near the two ends; and wherein an electrically conducting connection of the at least two conductor tracks to form a single flat coil is effected by connecting the first and second contacting surfaces of the support frame.

4. The diaphragm arrangement as set forth in claim 3;

wherein the first and second contacting surfaces are disposed on an uppermost layer of a multi-layer circuit board; and wherein the first and second contacting surfaces are connected together by through-contacting means on a lower layer of the circuit board.

5. The diaphragm arrangement as set forth in claim 1;

wherein the first contacting surface is disposed without overlapping beside the diaphragm.

6. The diaphragm arrangement as set forth in claim 5;

wherein the support frame includes an inner support frame and an outer support frame; and wherein the diaphragm covers the inner support frame and wherein the contacting surface is disposed on the outer support frame.

7. The diaphragm arrangement as set forth in claim 1;

wherein the diaphragm and the first contacting surface are disposed on different sides of the support frame.

8. The diaphragm arrangement as set forth in claim 1;

wherein the contacting surface of the support frame is connected to a through-contacting means that interrupts the support frame; and wherein the first contacting surface and an electrical connection that connects to the conductor track are disposed on different sides of the support frame.

9. A planar dynamic sound transducer comprising the diaphragm arrangement as set forth in claim 1.

10. A diaphragm arrangement for a planar dynamic sound transducer comprising:

a support frame that has a first contacting surface; and a diaphragm that is tensioned on the support frame and to which at least one electrically conductive conductor track is applied by coating;

wherein the diaphragm is fixed on the first contacting surface at a fixing region, the diaphragm is interrupted in the fixing region, and the conductor track applied by coating extends through the interruption on to the first contacting surface; and wherein the electrically conductive material is electrically conducingly connected to the first contacting surface.

11. The diaphragm arrangement as set forth in claim 10;

wherein the first contacting surface is electrically conductingly connected by a connecting wire.

* * * * *